US006657515B2

(12) United States Patent
Pappo et al.

(10) Patent No.: US 6,657,515 B2
(45) Date of Patent: Dec. 2, 2003

(54) TUNING MECHANISM FOR A SUPERCONDUCTING RADIO FREQUENCY PARTICLE ACCELERATOR CAVITY

(75) Inventors: Alfred Pappo, Melrose, MA (US); Chandrashekhar H. Joshi, Bedford, MA (US)

(73) Assignee: Energen, LLP, Billerica, MA (US)

( * ) Notice: Subject to any disclaimer, the term of this patent is extended or adjusted under 35 U.S.C. 154(b) by 0 days.

(21) Appl. No.: 10/174,529

(22) Filed: Jun. 18, 2002

(65) Prior Publication Data

US 2002/0190670 A1 Dec. 19, 2002

Related U.S. Application Data

(60) Provisional application No. 60/298,960, filed on Jun. 18, 2001.

(51) Int. Cl.[7] ..... H05H 9/00

(52) U.S. Cl. ..... 333/99 S; 333/231; 333/230; 505/500; 505/505; 505/5.41; 505/5.42; 250/492.3; 250/396 R

(58) Field of Search ..... 333/99 S, 230; 315/500, 5.41, 5.42, 5.16, 505; 250/492.3, 396 R; 324/636, 633; 505/500

(56) References Cited

U.S. PATENT DOCUMENTS 4,596,946 A * 6/1986 Pottier ..... 315/5.41
5,017,881 A * 5/1991 Palmer ..... 315/500
5,319,313 A * 6/1994 Vogel et al. ..... 333/99 S
5,336,972 A * 8/1994 Sheffield et al. ..... 315/5.41
5,401,973 A * 3/1995 McKeown et al. ..... 250/492.3
5,412,283 A * 5/1995 Tronc ..... 315/5.41
5,434,420 A * 7/1995 McKeown et al. ..... 315/307
5,451,794 A * 9/1995 McKeown et al. ..... 250/492.3
5,811,943 A * 9/1998 Mishin et al. ..... 315/505
6,097,153 A * 8/2000 Brawley et al. ..... 333/99 S
6,369,585 B2 * 4/2002 Yao ..... 324/636
6,407,505 B1 * 6/2002 Bertsche ..... 315/5.41

* cited by examiner

*Primary Examiner*—Michael Tokar
*Assistant Examiner*—Lam T. Mai
(74) *Attorney, Agent, or Firm*—Brian M. Dingman, Esq.; Mirick, O'Connell, DeMallie & Lougee, LLP

(57) ABSTRACT

A tuning mechanism for a superconducting radio frequency particle accelerator cavity, wherein the cavity comprises a number of axially aligned cells held by a frame, with at least one active cell that is axially stretchable to tune the resonant frequency of the cavity. The tuning mechanism comprises a lever arm having a center of rotation, one or more mechanical members coupling the lever arm to an active cell, and a motor adapted to move the lever arm, to thereby move the active cell through the mechanical members.

25 Claims, 2 Drawing Sheets

TUNING MECHANISM FOR A SUPERCONDUCTING RADIO FREQUENCY PARTICLE ACCELERATOR CAVITY

CROSS REFERENCE TO RELATED APPLICATION

This application claims priority of Provisional application Ser. No. 60/298,960, filed on Jun. 18, 2001.

FIELD OF THE INVENTION

This invention relates to a tuning mechanism for superconducting radio frequency (SRF) particle accelerator cavities. Tuning the frequency of a cavity takes place when the cavity is stretched or compressed along its beam axis, thereby changing its geometry and thereby its resonant frequency.

BACKGROUND OF THE INVENTION

SRF particle accelerator cavities need to be tuned in order to have maximum efficiency. A tuner at Jefferson Laboratories consists of a lead screw motor, two cell holders, and a dead leg. The cell holders are on each of the outer most cells. The lead screw and dead leg are connected to the cell holders on opposite sides of the cavity. One cell holder is rigid and the other is two parts, with an outer disk that pivots around the cell holder as the motor moves the disk. The pivot axis is perpendicular to the lead screw and dead leg, and is connected to the cell holder. As the motor progresses it rotates the disk, thereby pulling the outer cells apart. This stretches the cavity, which changes its resonant frequency.

A nickel magnetostrictive tuner system has been used for fine tuning these cavities. This system consists of a solid nickel rod that replaced the dead leg of the lead screw tuner described above. A superconducting coil surrounding the rod is used to activate the fine tuner. This system, however, requires a long rod of nickel since the magnetostriction of nickel is only about 30 ppm. The longer rod also requires a larger solenoid, creating a larger magnetic shielding problem for the SRF cavity system. The cavities are very sensitive to the presence of magnetic field during the cool down through the superconducting transition temperature.

Piezoelectric tuners could be used, however they do not operate at cryogenic temperatures, have low force output, and require high operating voltages. Having to feed a motor through the vacuum insulation causes a temperature gradient from the helium vessel to room temperature resulting in a larger heat load for the refrigeration system. Also, the low force output of piezoelectric motors requires the system to have a separate high force motor to do the coarse tuning. The voltage requirements for running a piezoelectric motor are five hundred to a few thousand volts.

CERN uses an SRF tuner with a room temperature motor that feeds through the cryostat to a lever system. The motor pulls ropes that twist rectangular bars on either side of the cavity. The bars have metal foils that connect the bars to the cavity and a rigid frame. As the bars are twisted, the foils rotate and pull the cavity and the frame together. The major disadvantage of this system is that the motor is located outside the cold source. This creates a temperature gradient across the feed through, warming the inside of the cryostat.

The APT tuner designed at LANL is composed of a motor that pushes on a lever arm. The lever arm is attached to plates on both sides of the neck of the cavity. Each plate has an intricate design of cuts to ensure lateral motion. Because of the time and detail that must go into the machining of these components, the tuner is very expensive.

Up to this point, the prior art tuning of particle accelerator cavities has been a choice of poor precision at low temperatures, or high precision while using a tuner outside of the cold source. SRF tuners up to this point have been very expensive mechanisms to build.

SUMMARY OF THE INVENTION

One difference between the inventive tuning mechanism and the prior art is the application of magnetic smart materials for motion. Magnetic smart materials change shape upon the application of a magnetic field. Elongating the material axially causes desired motion. Prior art piezoelectric materials rely on high voltages in order to elongate. Prior art lead screws are purely mechanical devices. Preferred materials comprise TbDyZn or TbDyFe alloys, which have strains of up to 5000 ppm. Such materials are disclosed in U.S. patent application Ser. No. 09/970,269, incorporated herein by reference.

The lever arm in the inventive motor also uses a higher mechanical advantage than other tuners, requiring less force from the motor and increasing the realized precision on the cavity from the motion of the motor. Wire ropes attached to the lever deal with axial loading; the wire ropes are pivoted at one end, allowing the transverse displacement of the lever to be negligible in the tuning of the cavity.

The inventive tuner combines high force and high precision at cryogenic temperatures. Another major advantage of the inventive tuner is its simplicity. Its low number of uncomplicated parts makes the tuner inexpensive to build and easy to setup and control. In addition to cost, magnetic smart materials require voltages 500 times less than those of piezoelectric materials to operate.

ADVANTAGES OF THE INVENTION

Precision Positioning:

The inventive motor can position with sub-micron precision. The lever arm has a mechanical advantage that also serves to increase precision. For every given amount the motor positions, the cavity is stretched a fraction of that displacement.

Elimination of Mechanical Feed Throughs in Cryostat:

Mechanical feed throughs cause heat to be leaked into the cryostat. A vital aspect of superconductivity is the ability to maintain low temperatures. The inventive motor can be entirely enclosed in the cold source. Only the coil leads have to be fed through the cryostat. There are commercially available feed throughs to translate an electrical signal through a cryostat without leaking any heat through the vacuum vessel.

Low Magnetic Fields:

Magnetic smart materials can achieve saturation of 5000 ppm at very low magnetic fields. These magnetic fields are about 1500 Oersteds, making it very easy to block the magnetic field from affecting the operation of the accelerator.

Low Voltage Operation:

The inventive tuner uses superconducting coils to produce the magnetic field at cryogenic temperatures. The superconducting coils carry high currents, approximately 5 to 10 amps, but require less than 2 volts to operate.

Low Temperature Operation:

Most particle accelerators currently being built or designed are superconducting. They have operating temperatures of below 4K, which suits well to the inventive tuner. The low temperatures allow the tuner to utilize superconducting coils, which can supply the magnetic field with negligible resistance in the coils. Therefore there is negligible heat dissipation and low voltage requirements.

No Lubricants Needed:

A major problem that engineers face when designing motors for cryogenic applications is the absence of lubrication. There are no lubricants that can survive cryogenic temperatures. Any motor with moving parts is going to require lubrication to offset wear. Utilizing magnetic smart materials to provide motion eliminates the need for lubrication.

This invention features a tuning mechanism for a superconducting radio frequency particle accelerator cavity, wherein the cavity comprises a number of axially aligned cells held by a frame, with at least one active cell that is axially stretchable to tune the resonant frequency of the cavity, the tuning mechanism comprising: a lever arm having a center of rotation; one or more mechanical members coupling the lever arm to an active cell; and a motor adapted to move the lever arm, to thereby move the active cell through the mechanical members.

The frame may comprise an end member spaced from the active cell. The lever arm may be located at least in part between the frame end member and the active cell. There may be a plurality of mechanical members coupling the lever arm to the active cell. The coupling from the lever arm to the active cell may be indirect. The tuning mechanism may further comprise an active cell holder coupled to the active cell. The plurality of mechanical members may connect the lever arm to the active cell holder.

The mechanical members may be coupled to the lever arm on one side of the center of rotation of the lever arm. The tuning mechanism may further comprise one or more additional mechanical members coupling the lever arm to the frame. The additional mechanical members may be coupled to the end member of the frame. The additional mechanical members may be coupled to the lever arm on the other side of the center of rotation of the lever arm.

The additional mechanical members may comprise wire ropes. The tuning mechanism may further comprise a guide over which each wire rope runs between the lever arm and the frame end member to change the direction of the wire rope to translate the direction of force on the frame end member from the lever arm. The mechanical members may comprise wire ropes. The tuning mechanism may further comprise a guide over which each wire rope runs between the lever arm and the active cell, to change the direction of the wire rope to translate the direction of motion of the lever arm to a different direction of motion of the active cell.

The motor may comprise a translating member that pushes on the lever arm, comprising a material that is elongated upon application of a magnetic field, and the motor may further comprise a coil proximate the material for providing a variable-strength magnetic field to the material. The material may be magnetostrictive. The motor may further comprise means for selectively clamping the translating member to inhibit its motion. The tuning mechanism and cavity may be operated at below 4 degrees Kelvin.

The motor may be rigidly connected to the frame. The frame may further comprise an inactive cell holder coupled to the cell furthest from the active cell, and a series of rigid frame rods connecting the inactive cell holder to the frame end member. The motor may comprise a rotating lead screw that pushes on the lever arm.

The tuning mechanism may further comprise a liquefied gas containing vessel surrounding the cavity, the vessel defining a flexible bellows, and the lever arm may be coupled to the vessel across the bellows with coupling on one side of the bellows to the lever arm on one side of the center of rotation, and coupling on the other side of the bellows to the lever arm on the other side of the center of rotation.

BRIEF DESCRIPTION OF THE DRAWINGS

Other objects, features and advantages will occur to those skilled in the art from the following description of the preferred embodiments, and the accompanying drawings, in which.

DETAILED DESCRIPTION OF THE PREFERRED EMBODIMENTS OF THE INVENTION

One preferred embodiment of the tuning mechanism of this invention uses a stepper motor to provide high force, high precision motion. The motor pushes against a lever arm to provide a mechanical advantage over the cavity. Each of the outer cells on the cavity has a cell holder attached to it to allow grabbing and positioning of the cell. One cell holder remains rigidly connected to the frame of the tuner and the other is active, moving along the axis of the cavity. The inactive cell holder is rigidly connected to an end plate positioned just beyond the active cell holder. The inactive cell holder, end plate and connecting members make up the frame. The end plate and active cell holder are connected to the lever arm by wire ropes. Each set of wire ropes, four to the end plate and four to the active cell holder, are on opposite sides of the center of rotation of the lever arm. The motor sits on a platform that is rigidly connected to the tuner's frame and pushes on the lever arm. The rotation of the lever arm pulls the end plate and active cell holder together, thus stretching the cavity and changing its resonant frequency.

Figure 1:
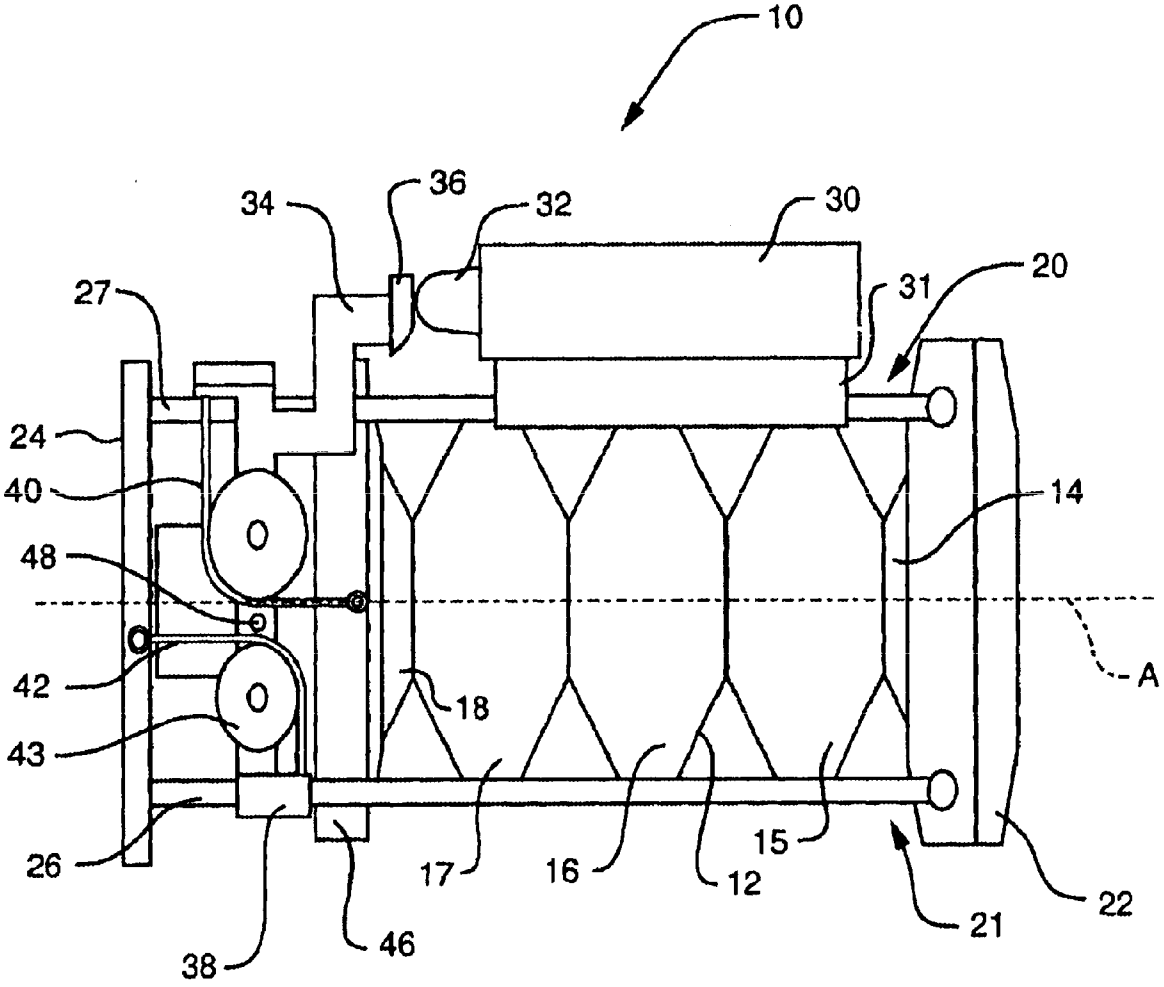
FIG. 1 is schematic, cross-sectional diagram of one embodiment of the tuning mechanism of this invention.

There is shown in FIG. 1 tuning mechanism 10 according to this invention for superconducting radio frequency particle accelerator cavity 20. Mechanism 10 causes a physical change in the length of cavity 20 to change its resonant frequency and thereby properly tune the cavity. Cavity 20 includes axially aligned cells 14–18 that are held by frame 21. There is one or potentially more active cells, in this example cells 15–17. Cells 15–17 are axially stretchable along longitudinal axis A to tune the resonant frequency of the cavity. In a broad sense, the tuning mechanism comprises a lever arm such as arm 34 that has center of rotation 48. The tuning mechanism further comprises one or more mechanical members that couple lever arm 34 to active cell 18. The tuning mechanism further includes motor 30 that is adapted to move lever arm 34, to thereby move active cell 18 through the mechanical members that couple lever arm 34 to active cell 18.

Frame 21 in this case comprises end member 24 spaced from active cell 18. Lever arm 34 is located in part between end member 24 and active cell 18. In this embodiment a plurality of mechanical members 40 comprise wire ropes. Ropes 40 couple lever arm 34 to active cell 18 through active cell holder 46 that is coupled to active cell 18. This accomplishes an indirect coupling of lever arm 34 to active cell 18. Active cell holder 46 is of a type known in the art that couples to active cell 18 to provide proper axial elongation motion of cavity 20. Mechanical member 40 is coupled to lever arm 34 on one side of center of rotation 48 of lever arm 34. This embodiment of the invention further comprises one or more additional members such as wire rope 42 that couple lever arm 34 closer to its distal end 38 to frame 21. In this example, these one or more wire ropes 42 are coupled to end member 24 of frame 21 on the other side of center of rotation 48 as compared to member 40. This arrangement provides a balanced axial force on active cell 18 to properly stretch or relax the cell in order to tune it appropriately.

The direction of wire ropes 40 and 42 is changed between their end points of attachment by running the wire ropes over guides 41 and 42, respectively. These guides translate the rotational motion of arm 34 about center of rotation 48 into axial motion along the direction of axis A. The wire rope and guide arrangement can be accomplished without the use of lubricants, which are unavailable at superconducting liquid helium temperatures of less then 4° Kelvin.

In this embodiment, there are actually four wire ropes 40 and four wire ropes 42 that are equally spaced around a periphery of cavity 20 to accomplish an even force.

Motor 30 moves translating member 32 which contacts distal end 36 of lever arm 34. Motor 30 may be a traditional rotating lead screw motor, but is preferably a magnetostrictive material-based motor that can operate at liquid helium temperatures. Due to the location of center of rotation 48, the relatively small displacements of member 32 are translated by lever 34 into even finer displacements of the active cavity, to accomplish the desired fine tuning. By carefully controlling the magnetic field applied to the magnetostrictive member, very small repeatable displacements are achievable. This is accomplished by providing a coil (not shown in the drawings) proximate the magnetostrictive material and controlling the current applied to the coil to provide a variable-strength magnetic field to the magnetostrictive material. The elongation of the material is related to the strength of the applied field.

Figure 2:
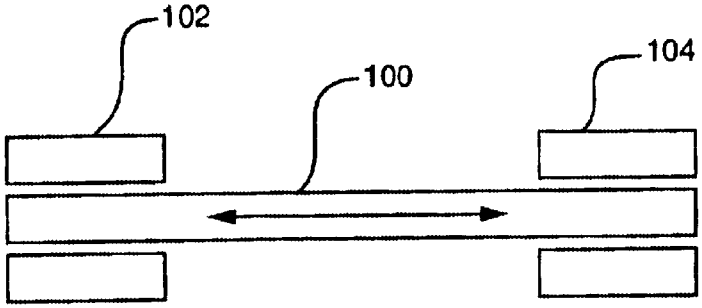
FIG. 2 is a partial schematic drawing of the active members of the preferred motor for the tuning mechanism of FIG. 1.

One embodiment of motor 30 is schematically depicted in FIG. 2. This is a schematic depiction of a magnetostrictive linear stepper motor that provides for relatively long stroke coarse adjustment, as well as fine tuning, as known in the art. Basically, these features are accomplished by providing selective clamping members 102 and 104 that can clamp translating member 100 to prevent one or both ends from moving. When member 100 is elongated, this allows for selective motion of member 100 in the direction of the arrow in the figure.

Turning back to FIG. 1, motor 30 is preferably rigidly connected to frame 21 by mounting motor 30 to platform 31 that is attached to frame 21. Frame 21 is accomplished in the embodiment of FIG. 1 by a combination of end member 24, inactive cell holder 22 that engages distal end cell 14 of cavity 20, and four circumferentially spaced stiff rods (two shown, labeled 26 and 27) that interconnect members 22 and 24. Rope 42 functions to hold distal end 38 of lever 34 in place relative to the frame, creating the center of rotation between the horizontal portions of ropes 42 and 40.

Figure 3:
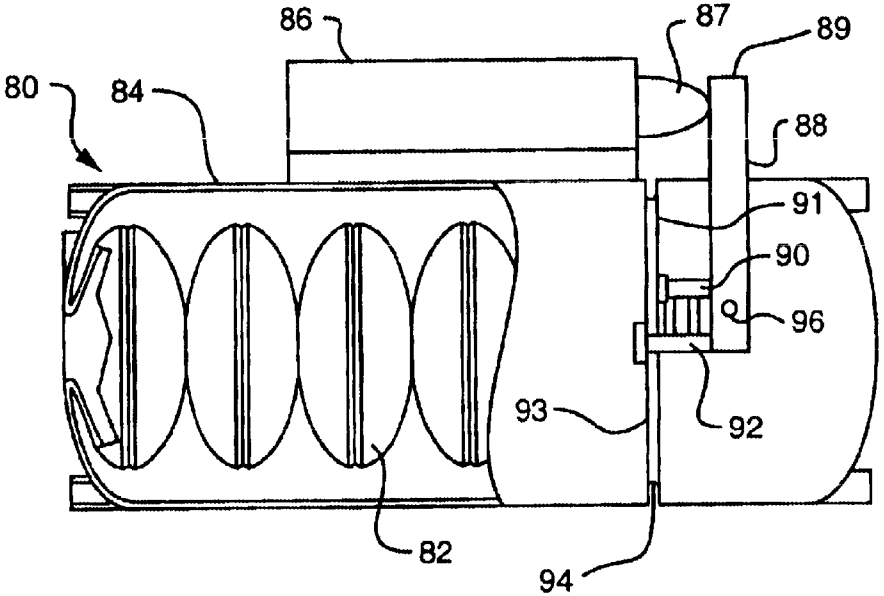
FIG. 3 is a schematic diagram of another preferred embodiment of the tuning mechanism of the invention.

Another embodiment of the invention is shown in FIG. 3. Liquefied gas-containing vessel 84 surrounds and is coupled to cavity 82. Vessel 84 defines a flexible bellows 94. In this embodiment, stepper motor 86 pushes distal end 89 of lever arm 88. The lower portion of lever arm 88 is connected to one side 91 and the other side 93 of bellows 94. When lever arm 88 is pushed, it rotates about center of rotation 96, causing member 90 to act in one direction on side 91 of bellows 94, and causing member 92 to act in the other direction on the other side 93 of bellows 94, so that there is a push-pull action to stretch or relax the bellows as appropriate in order to change the length of vessel 84. Since cavity 82 is fixed to vessel 84, providing this force to vessel 84 stretches or relaxes and thus tunes cavity 82. The motor and tuner exist in the vacuum space between the helium vessel and the outside shell. The motor is cooled by the helium through conduction. This arrangement is preferred since it utilizes a smaller helium vessel and is a more compact design.

Although specific features of the invention are shown in some drawings and not others, this is for convenience only as some feature may be combined with any or all of the other features in accordance with the invention.

Other embodiments will occur to those skilled in the art and are within the following claims:

What is claimed is:

1. A tuning mechanism for a superconducting radio frequency particle accelerator cavity, wherein the cavity comprises a number of axially aligned cells held by a frame, with at least one active cell that is held by an active cell holder and is axially stretchable to tune the resonant frequency of the cavity, the tuning mechanism comprising:

a lever arm having a center of rotation;

one or more mechanical members coupling the lever arm to an active cell holder; and a motor adapted to move the lever arm, to thereby move the active cell holder through the mechanical members.

2. The tuning mechanism of claim 1, wherein the frame comprises an end member spaced from the active cell holder.

3. The tuning mechanism of claim 2, wherein the lever arm is located at least in part between the frame end member and the active cell holder.

4. The tuning mechanism of claim 3, wherein there are a plurality of mechanical members coupling the lever arm to the active cell.

5. The tuning mechanism of claim 4, wherein the coupling from the lever arm to the active cell is indirect.

6. The tuning mechanism of claim 5, further comprising an active cell holder coupled to the active cell.

7. The tuning mechanism of claim 6, wherein the plurality of mechanical members connect the lever arm to the active cell holder.

8. The tuning mechanism of claim 4, wherein the mechanical members are coupled to the lever arm on one side of the center of rotation of the lever arm.

9. The tuning mechanism of claim 8, further comprising one or more additional mechanical members coupling the lever arm to the frame.

10. The tuning mechanism of claim 9, wherein the additional mechanical members are coupled to the end member of the frame.

11. The tuning mechanism of claim 10, wherein the additional mechanical members are coupled to the lever arm on the other side of the center of rotation of the lever arm.

12. The tuning mechanism of claim 10, wherein the additional mechanical members comprise wire ropes.

13. The tuning mechanism of claim 12, further comprising a guide over which each wire rope runs between the lever arm and the frame end member to change the direction of the wire rope to translate the direction of force on the frame end member from the lever arm.

14. The tuning mechanism of claim 4, wherein the mechanical members comprise wire ropes.

15. The tuning mechanism of claim 14, wherein the cavity has a longitudinal axis, the tuning mechanism further comprising a guide over which each wire rope runs between the lever arm and the active cell holder, to change the direction of the wire rope to translate the direction of motion of the lever arm to a direction of motion parallel to the longitudinal axis of the cavity.

16. The tuning mechanism of claim 1, wherein the motor comprises a translating member that pushes on the lever arm, comprising a material that is elongated upon application of a magnetic field, and the motor further comprises a coil proximate the material for providing a variable-strength magnetic field to the material.

17. The tuning mechanism of claim 16, wherein the material is magnetostrictive.

18. The tuning mechanism of claim 16, wherein the motor further comprises means for selectively clamping the translating member to inhibit its motion.

19. The tuning mechanism of claim 16, wherein the tuning mechanism and cavity are operated at below 4 degrees Kelvin.

20. The tuning mechanism of claim 1, wherein the motor is rigidly connected to the frame.

21. The tuning mechanism of claim 6, wherein the frame further comprises an inactive cell holder coupled to the cell furthest from the active cell, and a series of rigid frame rods connecting the inactive cell holder to the frame end member.

22. The tuning mechanism of claim 1, wherein the motor comprises a rotating lead screw that pushes on the lever arm.

23. The tuning mechanism of claim 1, further comprising a liquefied gas containing vessel surrounding the cavity, the vessel defining a flexible bellows, and wherein the lever arm is coupled to the vessel across the bellows with coupling on one side of the bellows to the lever arm on one side of the center of rotation, and coupling on the other side of the bellows to the lever arm on the other side of the center of rotation.

24. A tuning mechanism for a superconducting radio frequency particle accelerator cavity, wherein the cavity comprises a number of axially aligned cells held by a frame including an end member, with at least one active cell that is axially stretchable to tune the resonant frequency of the cavity, the tuning mechanism comprising:

a lever arm having a center of rotation;

one or more mechanical members coupling the lever arm to an active cell holder that is spaced from the frame end member;

an active cell holder coupled to the active cell;

a motor adapted to move the lever arm, to thereby move the active cell holder through the mechanical members;

wherein lever arm is located at least in part between the frame end member and the active cell, and wherein there are a plurality of mechanical members coupling the lever arm to the active cell holder;

wherein the mechanical members are coupled to the lever arm on one side of the center of rotation of the lever arm; and one or more additional mechanical members coupling the lever arm to the frame, wherein the additional mechanical members are coupled to the end member of the frame and are coupled to the lever arm on the other side of the center of rotation of the lever arm.

25. A tuning mechanism for a superconducting radio frequency particle accelerator cavity, wherein the cavity comprises a number of axially aligned cells held by a frame, with at least one active cell that is axially stretchable to tune the resonant frequency of the cavity, the tuning mechanism comprising:

a lever arm having a center of rotation;

one or more mechanical members coupling the lever arm to an active cell; and a motor adapted to move the lever arm, the motor comprising a translating member that pushes on the lever arm, comprising a magnetostrictive material that is elongated upon application of a magnetic field, and a coil proximate the material for providing a variable-strength magnetic field to the material, wherein the motor further comprises means for selectively clamping the translating member to inhibit its motion in one direction, to thereby move the active cell through the mechanical members, and wherein the motor is rigidly connected to the frame; and wherein the tuning mechanism and cavity are operated at below 4 degrees Kelvin.

* * * * *